US008235207B2

(12) United States Patent
Dietenberger

(10) Patent No.: US 8,235,207 B2
(45) Date of Patent: Aug. 7, 2012

(54) JIGSAW PUZZLE TRANSPORTING SYSTEM

(75) Inventor: Sabine Dietenberger, Bergatreute (DE)

(73) Assignee: Ravensburger Spieleverlag GmbH, Ravensburg (DE)

( * ) Notice: Subject to any disclaimer, the term of this patent is extended or adjusted under 35 U.S.C. 154(b) by 0 days.

(21) Appl. No.: 13/012,857

(22) Filed: Jan. 25, 2011

(65) Prior Publication Data

US 2012/0024729 A1 Feb. 2, 2012

(30) Foreign Application Priority Data

Jan. 25, 2010 (DE) ..... 10 2010 005 623

(51) Int. Cl.
*B65D 85/20* (2006.01)
*A63F 9/10* (2006.01)

(52) U.S. Cl. ..... 206/315.1; 273/148 R; 273/157 R

(58) Field of Classification Search ..... 206/315.1, 206/579; 273/148 R, 157 R; 108/69
See application file for complete search history.

(56) References Cited

U.S. PATENT DOCUMENTS

| | | | | |
|---|---|---|---|---|
| 1,987,496 | A | 2/1933 | Springborn | |
| 3,504,915 | A | 4/1970 | Walker | |
| 3,792,668 | A * | 2/1974 | Ward | 206/315.1 |
| 4,154,339 | A | 5/1979 | Dutra | |
| 4,302,013 | A * | 11/1981 | Kavis | 273/157 R |
| 4,479,651 | A | 10/1984 | Lafleur | |
| 4,486,018 | A * | 12/1984 | Keller, Jr. | 273/157 R |
| 5,651,547 | A * | 7/1997 | Rannelli | 273/157 R |
| 6,564,957 | B2 * | 5/2003 | Caldwell | 273/157 R |
| 7,287,647 | B1 * | 10/2007 | Licciardi | 206/579 |
| 7,552,821 | B1 * | 6/2009 | Demers et al. | 206/315.1 |

FOREIGN PATENT DOCUMENTS

| | | | |
|---|---|---|---|
| DE | 10 2007 052 846 | A1 | 5/2009 |
| EP | 0512453 | A1 | 11/1992 |
| GB | 2206807 | A1 | 1/1989 |
| WO | 99/22828 | A1 | 5/1999 |

OTHER PUBLICATIONS

Great Britain Search Report for Application No. GB1101069.1 dated May 19, 2011.

* cited by examiner

*Primary Examiner* — Bryon Gehman
(74) *Attorney, Agent, or Firm* — Carter, DeLuca, Farrell & Schmidt LLP

(57) ABSTRACT

A jigsaw puzzle transporting system having a bottom part, a base plate and a lid is provided. An at least substantially vertically projecting frame is present on the bottom part for peripherally surrounding the base plate. A shoulder with a holding face fitting into the frame projects from the lid. Side faces, mutually facing in a closed position, of the shoulder and of the frame cooperate for releasably locking the shoulder in the frame. The shoulder in the closed position is positioned, relative to the base plate received in the frame, such that a distance between the holding face and an upper surface, facing the latter, of the base plate is less than a jigsaw puzzle piece height.

14 Claims, 5 Drawing Sheets

JIGSAW PUZZLE TRANSPORTING SYSTEM

TECHNICAL FIELD

The invention relates generally to a system for storing and transporting loose pieces arranged in a plane. In particular, the invention relates to a jigsaw puzzle transporting system for a partially or completely assembled jigsaw puzzle.

BACKGROUND

Assembling jigsaw puzzle pieces is a popular pastime for people of widely varying ages, with degrees of difficulty matched accordingly. The degree of difficulty can be determined in particular by the number of jigsaw puzzle pieces. With an increasing number of jigsaw puzzle pieces, the probability of losing an individual jigsaw puzzle piece increases. The desired aim of completely assembling a jigsaw puzzle can thus become unattainable. To prevent loss of individual jigsaw puzzle pieces, the pieces are traditionally transported and stored in lockable boxes.

As the number of jigsaw puzzle pieces increases, so does the space and time required for complete assembly of the jigsaw puzzle pieces. There is often no suitable assembly surface. For lack of time, the solving of the jigsaw puzzle is often interrupted prematurely. Moreover, jigsaw puzzle pieces arranged in conventional boxes may be mixed again due to vibrations during transport.

For this reason, transport-safe storage systems for partially or completely assembled jigsaw puzzles have been developed. The document U.S. Pat. No. 3,504,915 describes a jigsaw puzzle box having a bottom part for doing the jigsaw puzzle on an integrated assembly surface, a drawer which can be pulled out under the assembly surface and is used to store individual jigsaw puzzle pieces, and a lid, the side faces of which completely encompass the outside of the bottom part, including the closed drawer, when the lid is closed. The laid-open application DE 10 2007 052 846 A1 describes a travel jigsaw puzzle container, in which an insert is received in a lower box half and has a plurality of compartments which can be closed by a base plate lying thereon. The base plate and any jigsaw puzzle pieces assembled thereon are secured by placing an upper box half thereover. On closing these transport-safe storage systems, large air volumes are displaced from the lid and flow past the assembled jigsaw puzzle pieces through narrow gaps at correspondingly high flow velocities, with the attendant risk of subjecting the jigsaw puzzle pieces to turbulence.

It is the object of the present invention to provide an improved jigsaw puzzle storing and transporting system.

SUMMARY

This object is achieved according to the invention by a jigsaw puzzle transporting system having the features of claim 1. The jigsaw puzzle transporting system comprises a bottom part, a base plate and a lid. A substantially vertically projecting frame is present on the bottom part tax peripherally surrounding the base plate. A shoulder with a holding face fitting into the frame projects from the lid. Side faces, mutually facing-in a closed position, of the shoulder and of the frame cooperate for releasably locking the shoulder in the frame. The shoulder in the closed position is positioned, relative to the base plate received in the frame, such that a distance between the holding face and an upper surface, facing the holding face, of the base plate is less than a jigsaw puzzle piece height.

Two functions can be achieved by the shoulder. Firstly, the shoulder fastened to the lid can cooperate with a corresponding side face of the frame fastened to the bottom pail. Thus, releasable locking between the lid and the bottom part can be achieved. The substantially vertically projecting frame on the bottom part can also be widened in a funnel shape for simplified releasable reception of the shoulder. Secondly, the holding face can contact any jigsaw puzzle piece lying on the base plate. A vanishing distance is also possible, so that in the closed position the holding face bears on the base plate without jigsaw puzzle pieces lying therebetween, but this is not imperative.

Furthermore, the shoulder can have a deformation property, so that on (even small) deformation of the shoulder (in particular of the holding face), the holding face produces a corresponding surface pressure which can arise in the closed position owing to the height of a jigsaw puzzle piece lying on the base plate. As a result of the surface pressure of the holding face on jigsaw puzzle pieces lying on the base plate, force locking can be induced between the jigsaw puzzle pieces and the base plate. The force locking can maintain the jigsaw puzzle pieces in a desired position on the base plate.

For precise positioning of the shoulder locked in the closed position, a side face of the shoulder can cooperate with an inner side face of the frame. The side face of the frame can project from the bottom part perpendicularly or in a conically widening manner. The side face of the shoulder can project from the lid perpendicularly or in a conically tapering manner (complementarily to the corresponding side faces of the frame. Corresponding latching elements (opposite in the closed position) on mutually facing side faces can be configured to engage with one another in the closed position.

For all-round locking, the side face of the shoulder can completely peripherally surround the latter. The latching elements can be arranged all the way round (preferably at regular intervals) on the respectively mutually facing side faces of the shoulder and the frame.

For storing individual jigsaw puzzle pieces, a plurality of indented compartments (preferably let into the bottom part) can be provided inside the frame. The base plate received in the frame (and bearing on the frame in the inside thereof) can close the indented compartments.

For simpler release of the locked closed position, the lid can project in an edge region laterally beyond the shoulder of the lid. An edge thickness of the lid is then less in the edge region than a shoulder height. In the closed position, the edge region can be grasped from the side. The edge region can thus be used virtually as a grasping strip for manually releasing the locking.

On closing and releasing the locking, air flowing between the shoulder and the frame can be conducted through a plurality of air conducting grooves in the holding face. In particular, the air can be discharged and supplied laterally in that the air conducting grooves are open towards the side lace of the shoulder.

In order to prevent adhesion of jigsaw puzzle pieces lying on the base plate to the holding face on releasing the locked lid, the air conducting grooves can form a regular channel network on the entire holding face. In addition, it is thus possible, preferably by a rectangular cross-sectional profile of the air conducting grooves, to achieve a dimensional stabilisation of the shoulder and hence of the holding face. The latter enables a uniform distribution of the surface pressure of the holding face on jigsaw puzzle pieces lying at different places on the base plate.

As an alternative to a rigid holding face, the holding face can be designed elastically deformably. In this case, the holding lace is preferably curved convexly (i.e. so as to bulge from the shoulder) in an open position. A curved convexly (i.e. so as to bulge from the shoulder) in the open position. A holding face pre-curved convexly in the open position can first come to bear on the base plate (or any jigsaw puzzle pieces lying thereon) at the centre of the surface. With increasing proximity to the closed position, the holding face can then bear on the base plate (or any jigsaw puzzle pieces lying thereon) up to the edge. A situation where jigsaw puzzle pieces lying close to an edge of the base plate cause reduction or elimination of the surface pressure towards the centre of the base plate can thus be precluded.

The shoulder can be a thermoformed part made of plastic, a thin-walled injection-moulded part made of plastic or a cardboard pressed part. The elastic deformability can thus be achieved by a deformability of the wall of the shoulder. For this purpose, the shoulder is preferably thin-walled. Furthermore, the shoulder can be a hollow body. In the case of a pressure-tightly sealed hollow body, a compressibility of an enclosed gas can contribute to the elasticity of the shoulder.

The lid can be prestressed (by a lid curvature in a longitudinal direction of the lid). The prestressing of the lid can curve the shoulder convexly in the open position. A more complex production of a (inherently) convex shoulder can then be dispensed with.

The shoulder can also be an elastic, foamed moulded part. In the case of a prestressed lid, the shoulder can be (inherently) biplanar and be curved biconvexly by the lid stress only after fastening to the lid. A plane-convex moulded part can be fastened to a plane lid. The moulded part can be produced by foaming a negative shape of the shoulder or by cutting out the shape of the shoulder from a (cured) foam volume.

The foamed moulded part can be air-permeable for an air circulating function (between the shoulder and jigsaw puzzle pieces lying on the base plate). For this purpose, a gas-percolating foam structure can be chosen.

For removal of the base plate received in the frame, at least one recess can be provided on the frame, at which recess an edge piece of the base plate (bearing on the frame in the inside thereof) lies exposed and can be grasped.

For one-handed transporting of the closed jigsaw puzzle transporting system, a first handle can be present on a first end region of the bottom part. For further securing of the closed position, a second handle can be present on a second edge region (opposite the first edge region in the closed position) of the lid.

An edge side of the bottom part and an edge side of the lid can be formed in the manner of a hinge. The lid and the bottom part can then be pivotably movable between an open position and the closed position. This can facilitate reception of the shoulder in the frame. In principle, in the open position the lid can define a support for the base plate on the shoulder. The bottom part can provide a storage side for jigsaw puzzle pieces. With a permanent (pivotably movable) connection of the bottom part and the lid, a fixed playing arrangement can be provided in the open position.

There can be provided on the edge side of the lid and on the edge side of the bottom part mutually parallel articulation axes. The two articulation axes can be spaced via a web element, arranged therebetween, in such a manner that a pivoting movement of the lid into the closed position tensions the web element. As a result of a tensile force transmitted via the articulation to the lid (and hence to the shoulder on the lid), additional force locking, acting in the sense of mutual bracing, between the facing surfaces in the closed position can be achieved.

BRIEF DESCRIPTION OF THE DRAWINGS

Further advantages and features of the invention will emerge from the exemplary embodiments described below with reference to schematic drawings, in which.

DETAILED DESCRIPTION

Figure 1:
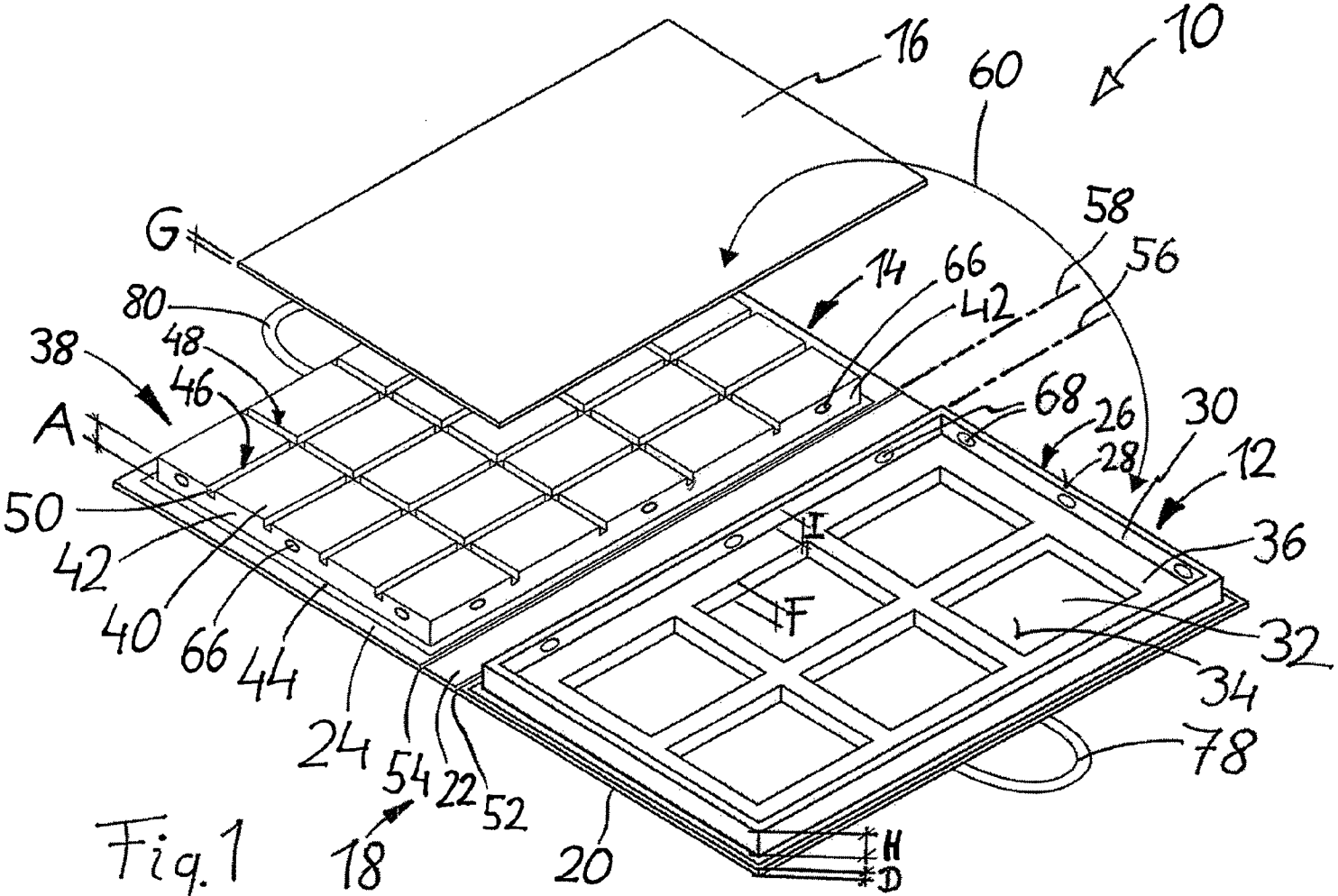
FIG. 1 shows a perspective illustration of a first exemplary embodiment of the jigsaw puzzle transporting system in an open position.

FIG. 1 shows a first exemplary embodiment of a jigsaw puzzle transporting system, designated generally by 10, comprising a bottom part 12, a lid 14 and a base plate 16. In the exemplary embodiment shown, a common covering surface IS connects the bottom part 12 foldably to the lid 14 and is divided into a lower base 20 of the bottom part 12, a hinge-like web 22 and an upper base 24 of the lid 14.

On the lower base 20, a rectangular frame 26 projects perpendicularly to the lower base 20 with an edge face 28 parallel to the lower base 20 and an inner side face 30, perpendicular to the lower base 20, of the frame 26. The frame 26 has, all the way round, a uniform height H from the lower base 20 which is a multiple of a base thickness D (which is the same for the lower base 20, the web 22 and the upper base 24). A plurality of indented compartments 32 each with a compartment bottom 34 are arranged regularly inside the frame 26. The frame 26 and the indented compartments 32 here form an integral thermoformed part. The indented compartments 32 terminate, with a compartment height F relative to the compartment bottoms 34, at a bearing face 36 which is common to all the indented compartments 32 and parallel to the lower base 20. The side face 30 of the frame 26 borders the bearing face 36 and is dimensioned such that the base plate 26 can be inserted into the frame 26 with a precise fit. The inserted base plate 16 bears on the bearing face 36 in a planar manner and closes the indented compartments 32. The frame 26 projects, with its side face 30 up to the edge face 28, by an internal height I beyond the bearing face 36. The internal height I of the side face 30 of the frame 26 is greater than a base plate thickness G of the base plate 16.

On the upper base 24, a shoulder 38 projects with a holding face 40 and a side face 42, by a shoulder height A relative to a bearing region 44, perpendicularly to the upper base 24. The shoulder 38 and the hearing region 44 are produced here as an integral thermoformed part. The holding face 40 has a plurality of intersecting air conducting grooves 46, 48 as longitudinal indentations and transverse indentations, respectively.

The air conducting grooves 46, 48 extend as far as the edge of the holding face 40 and lead into openings 50 in the side face 42. In cross-section, the air conducting grooves 46, 48 have a U-profile. Within a manufacturing tolerance, the shape and size of the holding face 40 are of the same size or slightly smaller than the bearing face 36.

The lower base 20 is pivotably-movably connected via a first fold 52 to the web 22 and the latter is in turn pivotably-movably connected via a second fold 54 to the upper base 24. The first fold 52 and the second fold 54 define two parallel pivot axes 56 and 58, respectively. After insertion of the base plate 16 into the frame 26 in the direction of the arrow 60, the lid 14 is pivoted by two superimposed pivoting movements 62 and 64 (see FIG. 2) from an open position shown in FIG. 1 over the bottom part 12. At corresponding places of the side face 42 of the shoulder 38 and of the side face 30 of the frame 26, a plurality of projecting ellipsoid sections 66 and indentations 68, respectively, are arranged. On continued pivoting movement of the lid 14, the ellipsoid sections slide over the side face 30 of the frame 26 and on reaching a closed position shown in FIG. 3, each one of the ellipsoid sections 66 projecting above the side face 42 engages in respectively one of the indentations 68. Owing to an elasticity of shape of the ellipsoid sections 66 (and also a flexural elasticity of the side face 42 of the shoulder 38 and of the side face 30 of the frame 26), the shoulder 38 is fixed in the closed position at a defined height in the frame 26 by releasable positive locking. Penetration of the shoulder 38 into the frame 26 beyond the closed position is prevented by the bearing region 44 bearing against the edge face 28.

To assemble a jigsaw puzzle, the lid 14 is pivoted into the open position shown in FIG. 1. The first fold 52 and second fold 54 are non-restoring, i.e. in the open position they do not produce a restoring moment (in the direction of the closed position), so that the common to covering surface 18 of the lower base 20 and of the upper base 24 lies flat, completely un-folded, on a plane underlying surface (such as a table top). The base plate 16 is removed from the frame 26 by a movement shown by the direction of the arrow 60 in FIG. 1 and placed on the shoulder 28. The base surface 16 serves as a jigsaw puzzle surface, on which a jigsaw puzzle formed of jigsaw puzzle pieces 70 lying in the indented compartments 32 can he constructed. The jigsaw puzzle transporting system can thus be quickly laid out, for example, on a table or while travelling in a vehicle or an aircraft. An optimal assembly surface is always provided by the base surface 16 contained in the jigsaw puzzle transporting system 10, so that it is possible to start the jigsaw puzzle immediately.

A further advantage of the jigsaw puzzle transporting system 10 is the possibility of interrupting the jigsaw puzzle at any stage in a matter of seconds without a lot of clearing-up work. For this purpose, the base plate 16 with the jigsaw puzzle pieces 72 completely or partially assembled thereon is placed back into the mount, formed by the frame 26, on the bottom part 12 in the direction of the arrow 60 shown in FIG. 1. Any jigsaw puzzle pieces 70 already pre-sorted for continuation of the jigsaw puzzle remain separated from one another in the indented compartments 32. Through the pivoting movement of the lid 14 into the closed position shown in FIG. 3, the shoulder 38 occupies its fixed position in the frame 26. In the closed position, there is a gap with a gap height S=I−G−A between the holding face 40, dimensionally stabilised as a result of the air conducting grooves 46, 48, and a facing upper side 74 of the inserted base plate 16. The gap height S is chosen to be slightly less than a thickness $S_P$ of the jigsaw puzzle pieces 72, in dependence on an elasticity (corresponding to a slight deformation) of the shoulder 40. Here, S is chosen to be between 0.80 $S_P$ and 0.95 $S_P$, preferably S=0.9 $S_P$. According to a deformation characteristic 76, shown in FIG. 4, of the shoulder (38) (at the holding face 40), a surface pressure P acts on the jigsaw puzzle piece 72 lying between the base plate 16 and the holding face 40 owing to the holding face 40 bearing on the jigsaw puzzle piece 72 since $S<S_P$. The (normal force of the) surface pressure results in force or frictional locking between each jigsaw puzzle piece 72 and the base plate 16. The partially or completely assembled jigsaw puzzle pieces 72 on the base plate 16 thus retain their position even if the jigsaw puzzle transporting system 10 is turned vertically so that the base plate 16 is parallel to the force of gravity. In this way, the jigsaw puzzle is fixed in the state that has been reached and is stored in a space-saving manner in a matter of seconds and without a lot of clearing-up work.

A lower handle 78 and an upper handle 80 are fastened, laterally in the centre, to the lower base 20 and the upper base 24, respectively, on a side opposite the web 22 in each ease. The handles 78, 80 form elastic loops parallel to the lower base 20 and upper base 24, respectively, and project laterally beyond the lower base 20 and upper base 24, respectively. When carrying the jigsaw puzzle transporting system 10 folded up in the closed position shown in FIG. 3, both handles 78 and 80 can be grasped by one hand, with the result that an additional closing force presses together the bottom part 12 and the top part 14 at the side opposite the web 22 and additionally counteracts undesired unfolding of the jigsaw puzzle transporting system 10.

Figure 3:
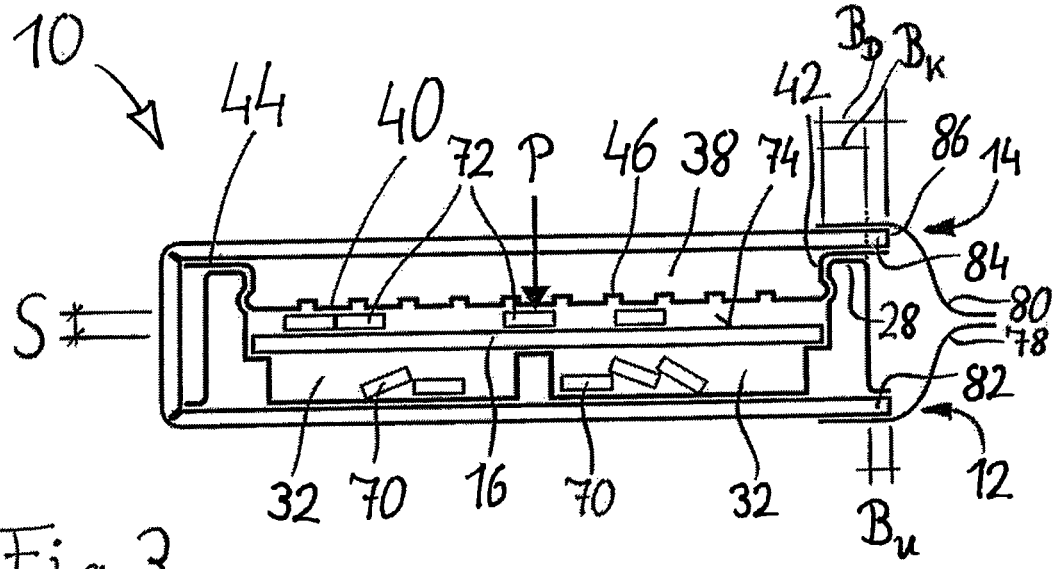
FIG. 3 shows a sectional view of the first exemplary embodiment of the jigsaw puzzle transporting system of FIG. 1 in a closed position.

As can best be seen in FIG. 3, the lower base 20 and the upper base 24 have respectively a flat lower edge region 82 with a width $B_U$ and a flat upper edge region 84 with a width $B_D$ at the side opposite the web 22. The upper edge width $B_D$ (between the side face 42 of the shoulder 38 and an edge 86 of the upper base 24) is greater than a width $B_K$ of the edge face 28, so that the upper edge region 84 projects laterally beyond the frame 26 in the closed position shown in FIG. 3. The edge width $B_U$ of the lower edge region 82 is chosen to correspond to the projection of the upper edge region 84. The lower edge region 82 and the upper edge region 84 form, at the side opposite the web 22 in the closed position, two grasping strips for manually opening the jigsaw puzzle transporting system 10 (in the closed position shown in FIG. 3). For this purpose, one hand each grasps respectively one of the edge regions 82 and 84 in order to apply a force sufficient to overcome the positive locking between the engaged ellipsoid sections 66 and indentations 68.

The flat and mostly light jigsaw puzzle pieces 72 present to an air flow a relatively large contact surface compared with their light weight. Besides the dimensional stabilisation of the holding face 40, the air conducting grooves 46, 48 have the advantageous effect of inhibiting turbulence formation on the closing and opening (shown in FIG. 2) of the lid 14 due to the pivoting movements 62 and 64. An air flow which forms on the closing of the lid 14 due to the holding face 40 coming closer to the upper surface 74 of the base plate 16 is conducted by the air conducting grooves 46, 48 to the free openings 50 at the side faces 42 of the shoulder 38. The air conducting grooves 46, 48 let into the shoulder 38 thus make it possible to prevent an air flow on the base plate 16 which lifts off the jigsaw puzzle pieces 72 lying loosely on the upper surface 74.

Furthermore, on the opening of the lid 14, the air conducting grooves 46, 48 create an air supply for quick pressure equalisation in the space between the holding face 40 and the jigsaw puzzle pieces 72. Adhesion, caused by negative-pressure formation, of the jigsaw puzzle pieces 72 lying loosely on the upper surface 74 to the holding face 40 lifting off during opening can thus be prevented. In particular, as a result of a substantially smooth upper surface 74 of the base plate 16, it is possible to achieve the effect that on the opening of the lid 14 greater adhesion acts between the base plate 16 and the loose jigsaw puzzle pieces 72 than between the holding face 40 and the jigsaw puzzle pieces 72. The jigsaw puzzle transporting system 10 can thus be quickly opened and closed without subjecting the jigsaw puzzle pieces 72 to turbulence.

The depth of the air conducting grooves depends on the flow volume. The air conducting grooves running at the surface may also be designed as discernible contours, for example in the form of a jigsaw puzzle structure, or as characters. Alternatively, instead of surface air conducting grooves, air conducting channels may be provided (concealed) behind the holding face 40 in the shoulder 38, the channels being fluidically connected to the holding face 40 via blind bores.

The jigsaw puzzle transporting system 10 is produced from adhesively bonded or (ultrasonically) welded plastic parts. In an alternative embodiment, the material used is cardboard or a combination of cardboard and plastic. A transparent plastic film (not shown) is stretched over the covering surface 18. A printed paper sheet with a size corresponding to the covering surface 18 can be inserted between the plastic film and the covering surface 18 for varying the design of the covering surface 18. Alternatively, the covering surface 18 is permanently designed with printed decorations, pictures or logos.

Figure 2:
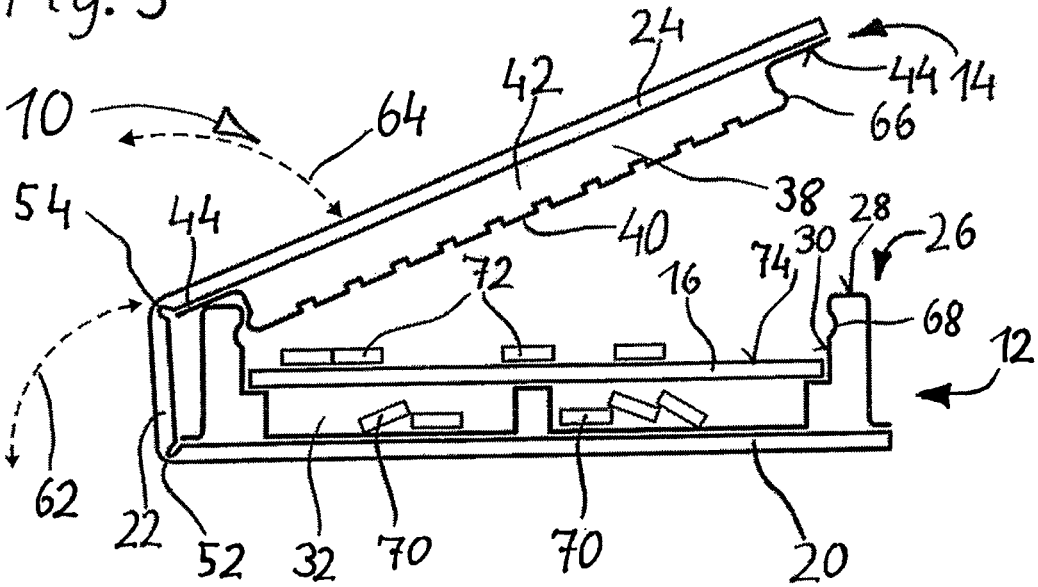
FIG. 2 shows a sectional view of the first exemplary embodiment of the jigsaw puzzle transporting system of FIG. 1 in an intermediate position.
Figure 5:
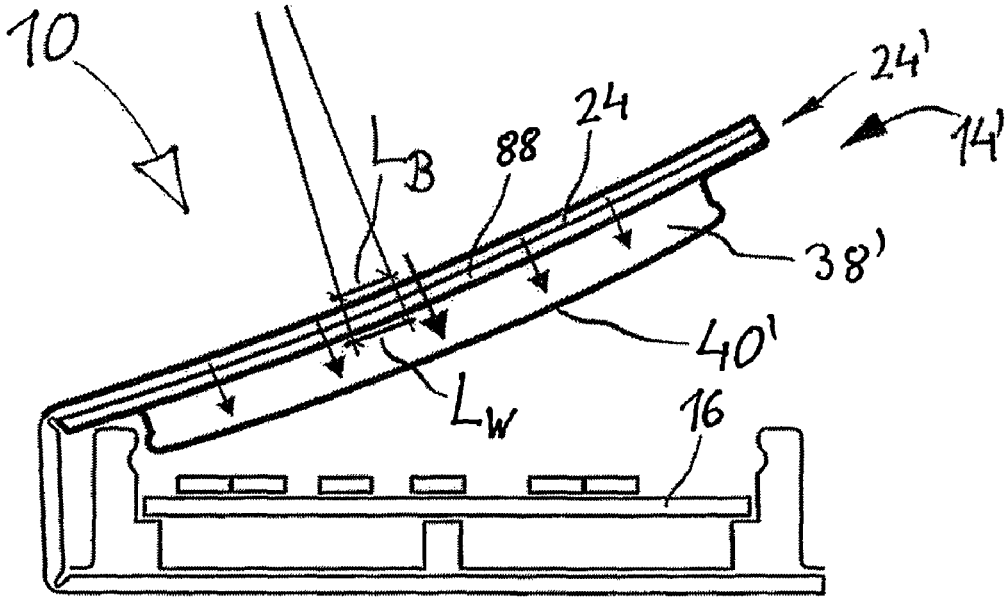
FIG. 5 shows a sectional view of the second exemplary embodiment of the jigsaw puzzle transporting system in the intermediate position.
Figure 6:
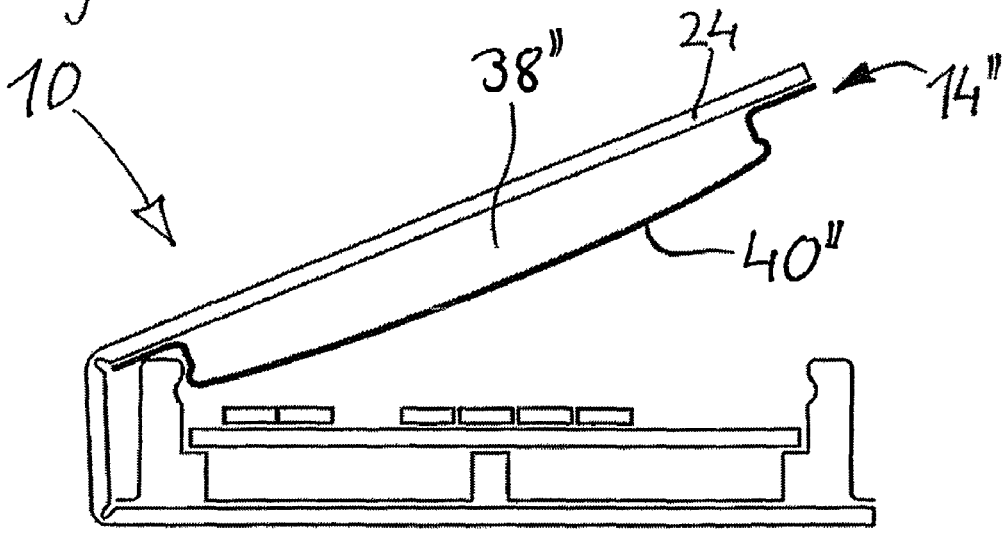
FIG. 6 shows a sectional view of the third exemplary embodiment of the jigsaw puzzle transporting system in the intermediate position.

FIGS. 5 and 6 show respectively a second and third exemplary embodiment of the jigsaw puzzle transporting system 10, which differs from the first exemplary embodiment shown in FIGS. 1 to 3 only in the design of the lid 14. The second exemplary embodiment shown in FIG. 5 has a lid 14' with a double layer 24' comprising the upper base 24, integrally connected to the web 22 via the first fold 52, and an additional curved layer 88. A curvature, shown in FIG. 5, of the double layer 24' can be produced by a surface connection of the upper base 24 and the curved layer 88 in the curved state of the layers 24, 88. For this purpose, a substantially full-surface adhesive bond of the upper base 24 and the curved layer 88 is pressed in a correspondingly curved pressing mould until the bond has cured. Since in each case one surface element of a length $L_W$ (perpendicular to the pivot axis 58) of the curved layer 88 is adhesively bonded to a somewhat shorter surface element of length $L_B$ of the upper base 24, the desired curvature of the double layer 24' results. The curvature of the double layer 24' is transmitted to the elastic shoulder 38' fastened to the double layer 24' and leads to a convex curvature of the holding face 40'. As a result of this pre-bending of the lid 14' in the open position, a pressure on the base plate 16 distributed uniformly (laterally) over the holding face 40' in the closed position is achieved. In particular, a partial lifting-off of the holding face 40' from the base plate 16 (or the assembled jigsaw puzzle pieces 72) in the closed position is prevented.

FIG. 6 shows a third exemplary embodiment of the jigsaw puzzle transporting system 10 with a lid 14". The lid 14" comprises a plane upper base 24 and a plane-convex shoulder 38", one side, connected to the upper base, of the shoulder 38" being plane and the holding face 40" being convex. The shoulder 38" is a plastic thermoformed part with an elastic holding face 40".

In a variant, the shoulder 38" is a plane-convex moulded part made of elastic foam (in the cured state). The foam imparts the elasticity to the holding face 40". Furthermore, the holding face 40" has a structure comprising many small surface Openings, owing to the porosity of the foam in the shoulder 38". The foam material thus achieves a comparable air circulating function to that described in the first exemplary embodiment with reference to FIGS. 1 to 3.

Figure 4:
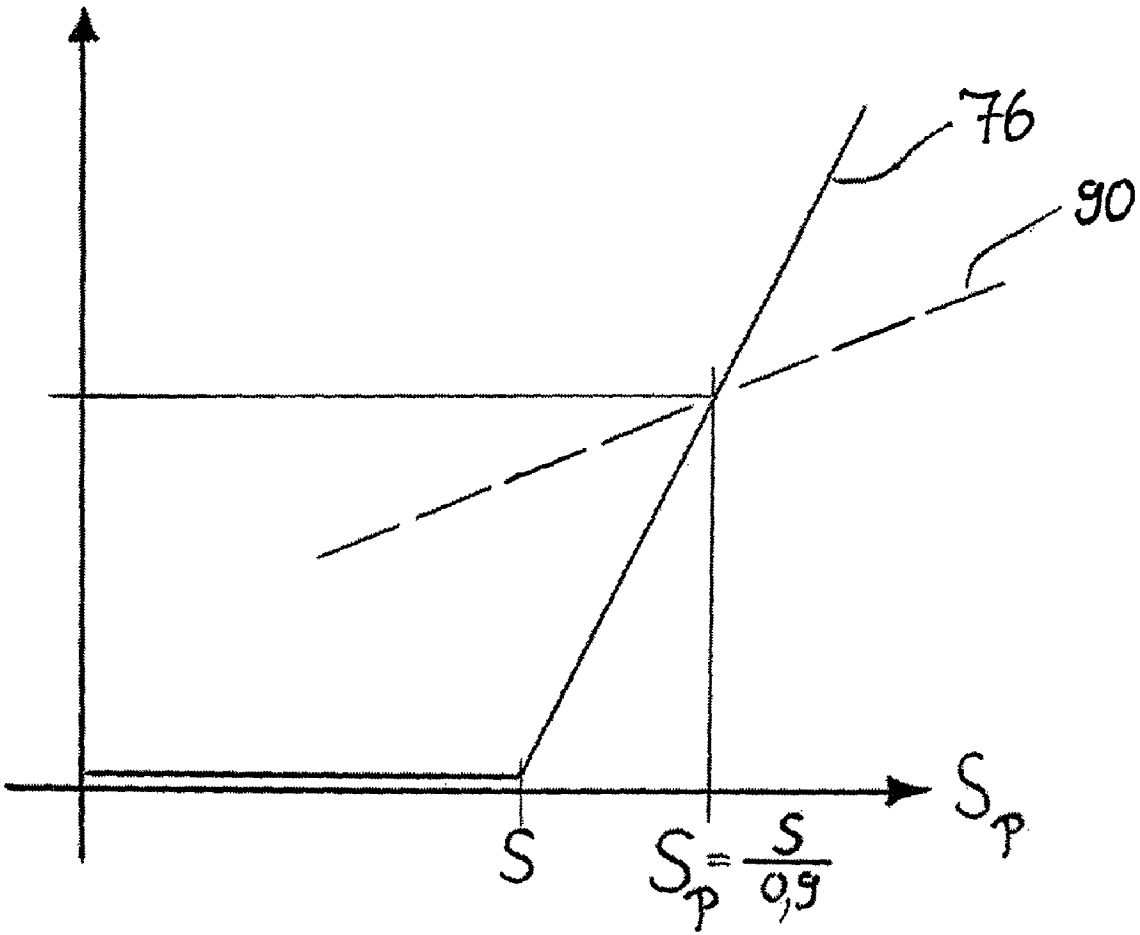
FIG. 4 shows qualitative profiles of deformation properties of the first and a second exemplary embodiment of the jigsaw puzzle transporting system.

A (generally location-dependent) deformation characteristic 90 of the elastic holding face 40" is shown (for a randomly chosen point in the holding face 40") in FIG. 4. A shallower gradient of the deformation characteristic 90 compared with the deformation characteristic 76 corresponds to the greater hardness of the dimensionally stabilised holding face 40 at a comparably chosen surface pressure P (point of intersection of both deformation characteristics).

Figure 7:
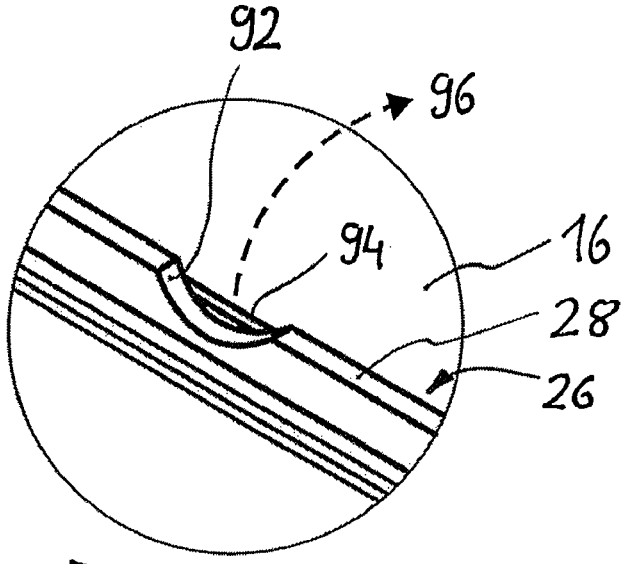
FIG. 7 shows a detail view of a grasping aid.
Figure 8:
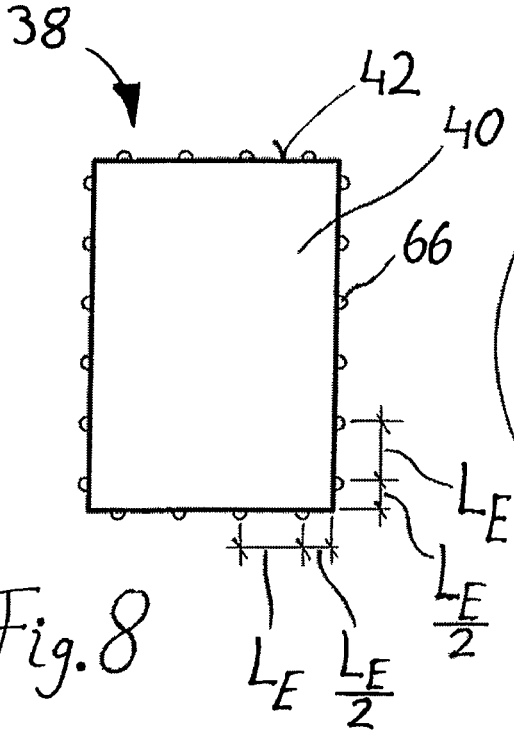
FIG. 8 shows a plan view of a shoulder with latching elements.
Figure 9:
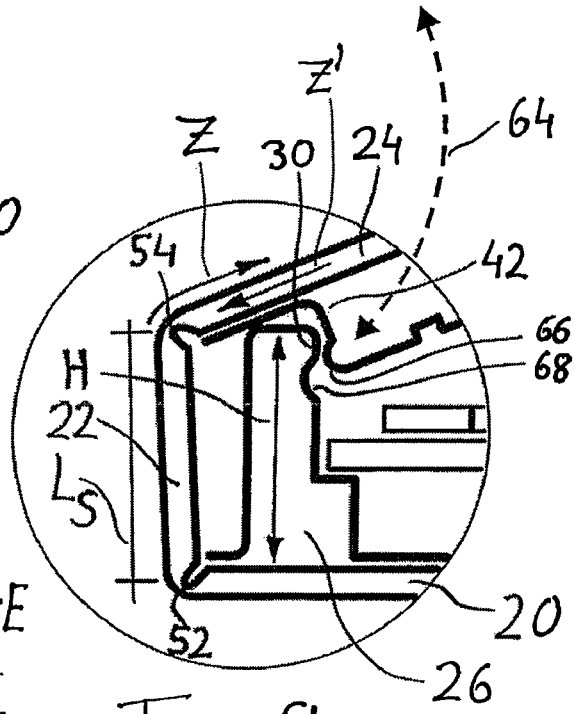
FIG. 9 shows a detail view of a tension securing means.

FIGS. 7 to 9 show further detail designs which can each be combined with each of the above-described exemplary embodiments of the jigsaw puzzle transporting system 10. FIG. 7 shows an enlarged detail view of the frame 26 with the base plate 16 inserted in the frame 26. A circular-segment recess 92 acting as a grasping aid is provided on the edge face 28 of the frame 26. An edge piece 94 of the base plate 16 lies exposed in the circular-segment recess 92. The exposed edge piece 94 can be removed from the frame 26 by a finger in the direction shown by arrow 96. In a preferred embodiment, a single circular-segment recess 92 is provided laterally in the centre on one of the short sides of the frame 26 shown in FIG. 1. On removal, the exposed edge piece 94 is lined above the edge face 28, with the result that the base plate 16 is inclined by a small angle corresponding to the longer side of the base plate 16. Through the small inclination, slipping of jigsaw puzzle pieces 72 lying loosely on the base plate 16 can be avoided. Alternatively, a respective circular-segment recess 92 can be arranged laterally in the centre on each opposite side. It is also possible for two respective circular-segment recess 92 to be provided on both longer sides of the frame 26. The latter embodiment makes it possible to remove the base plate 16 stably from the frame 26 with two pairs of fingers.

FIG. 8 shows a plan view of the shoulder 38 with the holding face 40 and the side face 42 (parallel to the viewing direction). A multiplicity of ellipsoid sections 66 project at regular intervals $L_E$ all the way round on the side face 42 of the shoulder 38. As a result of the multiplicity of ellipsoid sections 66 which in the closed position each engage with a corresponding indentation 68 on the side lace 30 of the frame 26, the closed position is also secured against considerably vibrations during transport. Owing to the pivoting movement of the lid 14, on opening not all of the ellipsoid sections 66 and indentations 68 are disengaged at the same time. This prevents a sudden jerk on opening, which would displace the jigsaw puzzle pieces 72 lying on the base plate 16.

FIG. 9 shows a detail view of the web 22 pivotably-movably connecting the bottom part 12 and the lid 14. A length $L_S$ of the web 22 between the first fold 52 and the second fold 54 is dimensioned somewhat shorter in relation to the shoulder height H, so that on pivoting 64 into the closed position a tensile force Z is transmitted by the upper base 24 via the second fold 54 to the web 22. The tensile stress Z of the upper base 24 is maintained in the closed to position by a reaction Z' of the web 22 and produces an additional contact pressure of the facing side faces 30 and 42. The contact pressure produces additional force locking between the engaged latching elements 66 and 68.

The invention claimed is:

1. Jigsaw puzzle transporting system comprising:

a bottom part;

a base plate;

a lid; wherein an at least substantially vertically projecting frame is present on the bottom part for peripherally surrounding the base plate;

a shoulder with a holding face fitting into the at least substantially vertically projecting frame and projecting from the lid, wherein the holding face comprises a plurality of air conducting grooves, each of which opens out into a side face of the shoulder, the plurality of air conducting grooves forming a regular channel network on the entire holding face; and side faces mutually facing in a closed position, of the shoulder and of the at least substantially vertically projecting frame cooperating for releasably locking the shoulder in the at least substantially vertically projecting frame;

wherein the shoulder in the closed position is positioned, relative to the base plate received in the at least substantially vertically projecting frame, such that a distance between the holding face and an upper surface, facing the holding face, of the base plate is less than a jigsaw puzzle piece height.

2. System according to claim 1, wherein, for the locking, a side face of the shoulder faces a side face of the at least substantially vertically projecting frame and corresponding latching elements on the mutually facing side faces engage with one another in the closed position.

3. System according to claim 2, wherein the side face peripherally surrounds the shoulder and the latching elements are arranged at regular intervals on the respectively mutually facing side faces.

4. System according to claim 1, wherein a plurality of indented compartments are provided inside the at least substantially vertically projecting frame in the bottom part, which are closed by the base plate received in the at least substantially vertically projecting frame.

5. System according to claim 1, wherein, in an edge region of the lid, the shoulder is spaced from the edge of the lid and an edge thickness of the lid is less than a shoulder height.

6. System according to claim 1, wherein the holding face is elastically deformable and is curved convexly in an open position.

7. System according to claim 6, wherein the shoulder is a thermoformed part.

8. System according to claim 6, wherein the shoulder is an elastic foam moulded part.

9. System according to claim 8, wherein the elastic foam moulded part is air-permeable.

10. System according to claim 1, wherein the lid is prestressed.

11. System according to claim 1, wherein at least one recess is provided on the at least substantially vertically projecting frame, at which recess an edge piece of the base plate received in the at least substantially vertically projecting frame lies exposed.

12. System according to claim 1, wherein a first handle is provided on an edge region of the bottom part and a second handle is provided on an edge region, opposite in the closed position, of the lid.

13. System according to claim 1, wherein an edge side of the bottom part and an edge side of the lid are articulated and are pivotably movable between an open position and the closed position.

14. System according to claim 13, wherein there is provided on the edge side of the lid and on the edge side of the bottom part a respective articulation axis, which are mutually parallel and are spaced via a web element in such a manner that a pivoting movement of the lid into the closed position tensions the web element.

* * * * *